US006990751B2

(12) United States Patent
Riley et al.

(10) Patent No.: US 6,990,751 B2
(45) Date of Patent: Jan. 31, 2006

(54) ROTATABLE AIR KNIFE

(75) Inventors: Terence M. Riley, Fullerton, CA (US); Daniel J. VanderPyl, Fullerton, CA (US)

(73) Assignee: Sonic Air Systems, Inc., Fullerton, CA (US)

( * ) Notice: Subject to any disclaimer, the term of this patent is extended or adjusted under 35 U.S.C. 154(b) by 15 days.

(21) Appl. No.: 09/970,568

(22) Filed: Oct. 3, 2001

(65) Prior Publication Data

US 2003/0061725 A1 Apr. 3, 2003

(51) Int. Cl.
*F26B 3/32* (2006.01)

(52) U.S. Cl. ..... 34/506; 34/236; 34/638; 34/639

(58) Field of Classification Search ..... 34/488, 34/500, 506, 510, 236, 241, 242, 638, 639, 34/642

See application file for complete search history.

(56) References Cited

U.S. PATENT DOCUMENTS

| | | | | | |
|---|---|---|---|---|---|
| 2,418,045 | A | * | 3/1947 | Neider | 15/405 |
| 2,602,003 | A | | 7/1952 | Wellborn | 239/259 |
| 3,361,361 | A | * | 1/1968 | Schutte | 239/227 |
| 3,579,853 | A | | 5/1971 | Martino | 34/218 |
| 4,175,575 | A | | 11/1979 | Cushing | 134/176 |
| 4,854,951 | A | * | 8/1989 | Stephenson | 55/294 |
| 5,107,629 | A | * | 4/1992 | Boyd et al. | 451/38 |
| 5,173,987 | A | | 12/1992 | Buckingham | 15/301 |
| 5,228,614 | A | * | 7/1993 | Elliott et al. | 228/37 |
| 5,498,036 | A | * | 3/1996 | Kingsford | 285/138 |
| 5,531,833 | A | | 7/1996 | Ogasawara | 118/698 |
| 5,553,633 | A | | 9/1996 | Ciccarelli, Jr. et al. | 134/72 |
| 5,555,635 | A | * | 9/1996 | Seidl | 34/79 |
| 5,770,241 | A | * | 6/1998 | Tuzzio et al. | 425/232 |
| 5,776,211 | A | | 7/1998 | Jacob | 55/356 |
| 6,050,392 | A | | 4/2000 | Straub | 198/495 |
| 6,108,938 | A | | 8/2000 | Jones | 34/487 |
| 6,129,099 | A | | 10/2000 | Foster et al. | 134/57 R |

* cited by examiner

*Primary Examiner*—Denise L. Esquivel
*Assistant Examiner*—Kathryn S. O'Malley
(74) *Attorney, Agent, or Firm*—Jeffrey G. Sheldon; Sheldon & Mak

(57) ABSTRACT

An air knife or air nozzle manifold for drying or blowing off passing articles moved by a conveyor system is provided with a coupling that permits rotation of the air knife or air nozzle manifold relative to the air inlet duct leading from a blower. The air knife or air nozzle manifold has opposing ends located equidistant from a longitudinal axis of rotation relative to a stationary element of the coupling. Thrust nozzles are provided at each of the opposing ends of the air knife or air nozzle manifold to deflect a certain portion of the air from the plenum chamber to provide thrusting jets of air that rotate the air knife or air nozzle manifold about the longitudinal axis. The flow of air emitted from the air knife or air nozzle manifold is thereby directed onto the passing articles from different directions as the articles move by. The efficiency of drying and blowing off the articles to be processed is thereby significantly improved.

28 Claims, 7 Drawing Sheets

ROTATABLE AIR KNIFE

BACKGROUND OF THE INVENTION

1. Field of the Invention

The present intervention is an apparatus, such as an air knife or an air distribution manifold, for directing air under pressure at passing articles to dry or remove dust and debris from those articles.

2. Description of the Prior Art

Conventional air knives and air distribution manifolds are often formed as elongated structures that extend alongside or transverse to a conveyor belt or conveyor chain carrying articles to be dried or blown clean. Air knives are extensively used for drying a wide variety of articles of manufacture, such as plastic soft drink bottles prior to labeling, printed electronic circuit boards, food packaging, and many other products. Conventional pressure air delivery devices in the form of air knives and air nozzles have been used in a wide variety of industrial and commercial processes to remove or control the amount of liquids remaining on the surfaces of products after washing, rinsing, cooling, coating, or lubricating fluids have been applied. The same air delivery devices have also been used to blow dust and debris from products as well as to accelerate the heating or cooling of products. Applications for air knife and air nozzle blow off include printed circuit board assembly, machine parts, fabricated metals, plastic trays and totes, conveyor belts, electroplating, assorted textiles, food production and packaging, car and truck washing, and many other applications as well.

Conventional air knives and air distribution manifolds are usually mounted in a fixed orientation relative to a conveyor system past which articles to be dried or cleaned are carried. One disadvantage of conventional systems of this type is that the article to be dried or blown clean passes through the curtain of air being blown at it for only a very brief instant. Also, the flow of air of a conventional system is directed at the article to be treated from only a single direction. The configuration of the article is often such that "blind spots" are created on the portions of the article facing away from the oncoming airflow. These blind spots result from the fixed angle at which the airflow is directed against the product. Air velocity is much lower in these blind spots, thus reducing the drying or cleaning effect of the flowing air. As a consequence, the article is often inadequately dried or cleaned.

In order to achieve complete drying, multiple air knives, nozzles, and blowers have often been required. A conventional motor-driven rotary air knife must be coupled by a shaft, gear, chain, or belt to a drive motor. Such additional driving equipment increases both the cost and complexity of the air knife system.

Some conventional air knife systems have been designed to impart a rocking movement to the air knife duct or to otherwise vary the angle at which the air is directed toward the article. Other prior systems employ a motor to oscillate the air knife or nozzle in one plane so as to cause a lateral air blow off across the surface of a product. However, conventional devices of this type have been largely unsatisfactory. The effective area of coverage and the number of passes over the surface of products to be treated are quite limited as contrasted to the system of the present invention. Also, such conventional systems result in very slow product speeds of conveyance and sometimes even extended stationary product positioning to ensure adequate air blow off coverage of the product.

SUMMARY OF THE INVENTION

The present intervention involves an improved construction for an air knife or air delivery manifold having a plurality of primary pneumatic ejection nozzles for cleaning or blowing off articles of manufacture or other products. According to the present intervention the air knife or air jet manifold is constructed with laterally separated, opposing ends and mounted for rotation about a longitudinal axis equidistant from its opposing ends. Furthermore, the system requires no mechanical drive mechanism to rotate the air knife or air jet manifold. Rather, a small thrust nozzle is located at each of the opposing ends of the air knife or air distribution manifold and is directed so as to exert a tangential, rotational force on the opposing ends of the structure to rotate it about the longitudinal axis passing through its center. The thrust nozzles divert a small amount of the air flowing into the plenum of the air knife or air distribution manifold so that no externally powered drive system is required to rotate it.

By rotating the air knives and air distribution manifolds about a central, longitudinal axis, rather than positioning them in static, fixed orientations relative to the conveyor system, each passing article is exposed to the airflow for a considerably longer period of time and from varying directions than is the case with conventional air knife systems. Considered another way, the rotating air knife reaches out to the approaching article to direct an airflow at it, then delivers air at it from continuously varying directions, and then follows the article to a certain extent as it leaves the proximity of the air knife.

The advantage of this improvement is that by rotating an air knife over an article, such as a printed circuit board, for example, there is an increase in dwell time of the air knife over the article. Also, the article can be dried or blown off more effectively since the airflow impinges upon the article from different directions as the air knife rotates. This increase in effectiveness means that the articles can be dried or blown off in a shorter amount of time, thereby allowing the speed of the conveyor system to be increased. Furthermore, because the air knife or air distribution manifold is continuously rotating as the article passes it, airflow is directed at the passing article from constantly changing directions. This increases the drying effectiveness which also allows conveyor speed to be increased.

In one broad aspect the present invention may be considered to be an apparatus for directing air under pressure at passing articles. The apparatus of the invention is comprised of an air distribution enclosure, at least one thrust nozzle, a blower, and a rotatable coupling. The air distribution enclosure has opposing laterally separated ends. Air under pressure from these opposing ends is directed at the passing articles. A central inlet opening is located midway between the opposing ends. This central inlet opening defines an axis of rotation.

Thrust nozzles are located at one or both of the opposing ends of the distribution enclosure to receive air from within the enclosure. The thrust nozzles are directed to emit jets of air in a tangential direction relative to the longitudinal axis. The blower has an inlet duct leading to the inlet opening in the air distribution enclosure. A rotatable coupling joins the air distribution enclosure to the inlet duct and permits rotation of the air distribution enclosure relative to the inlet duct.

The air distribution enclosure may be an elongated air knife having a narrow air discharge slot extending between the opposing ends. Such an air knife expels air not only at its opposing ends, but rather it discharges air in a band that extends linearly between the opposing ends. The band of air flow is emitted through the narrow air discharge slot that is rotated over a circular area by the jets of air emitted from the thrust nozzles. These air jets rotate the air knife about the longitudinal axis and in a plane parallel to the direction of conveyor advancement.

The thrust nozzles may have a fixed configuration and a discharge orifice of fixed area and shape. With this configuration the thrust turning the air knife in rotation is determined solely by the pressure of air within the plenum. Preferably, however, each of the thrust nozzles is provided with an adjustment mechanism, such as an infinitely variable orifice valve, to vary the force of the jets of air. These adjustment mechanisms may be manipulated so as to direct a greater or smaller portion of the air in the plenum through the thrust nozzles.

While a variety of different kinds of couplings may be employed, the coupling system that joins the air knife to the blower duct is preferably a low friction device. A bearing ring may be interposed between the stationary and rotatable components of the coupling in order to reduce friction. However, it is also highly advisable to minimize any escape of air through the coupling components. This may be done by constructing the stationary and rotatable components of the coupling to define a tortuous path of resistance to the flow of air radially outwardly from the coupling with respect to the longitudinal axis.

In this connection the stationary and rotatable components of the coupling may respectively include stationary and rotatable tubular structures that define radially projecting flanges at their extremities. The flanges reside in mutually facing relationship. One or a plurality of annular grooves may be defined in one of the flanges while one or a plurality of raised rings may be defined in the other flange. The rings fit easily into the grooves to permit rotation of the rotatable tube relative to the stationary tube but the nonplanar configuration of the flanges provides the necessary tortuous path of resistance to radial airflow out through the walls of the coupling.

The invention is not necessarily limited to air knives in which air is emitted from a single, long, narrow slot. Sometimes a manifold having a plurality of separate primary drying or blowoff outlet nozzles is used instead of an air knife. These primary nozzles may be located only at the ends of the manifold, but are more typically spaced along its length between the ends as well as at the ends of the manifold.

In another aspect the invention may be considered to be an apparatus for directing a flow of air on passing articles. The apparatus is comprised of an air distribution structure having a longitudinal axis and opposing ends located equidistant from the longitudinal axis. The air distribution structure is configured with at least one primary outlet to emit a flow of air in a longitudinal direction along a laterally extending swath. The air distribution structure is equipped with thrusting air jet nozzles located at its opposing ends. The thrusting air jet nozzles are oriented tangentially relative to the longitudinal axis so as to deliver sufficient thrust to rotate the air distribution structure about the longitudinal axis. As a result, the swath is swept in a circle centered upon the longitudinal axis.

The air distribution structure may be either an air knife or an elongated air manifold having a plurality of primary outlet nozzles spaced along its length. The air distribution structure forms part of an overall system which additionally comprises a blower having an inlet duct leading to the air distribution structure and also a coupling. The coupling has a stationary tubular member oriented coaxially with the longitudinal axis. The air distribution structure has an inlet opening centered on the longitudinal axis and a rotatable tubular member projecting from the inlet opening in the air distribution structure to the stationary tubular member. The rotatable tubular member of the coupling is in coaxial alignment with the stationary tubular member of the coupling. A bearing ring is interposed between the stationary tubular member and the rotatable tubular member.

In still another aspect the invention may be considered to be an improvement in an air knife assembly for directing a flow of air at passing articles. The assembly includes an elongated air distribution enclosure having opposing ends. The air distribution enclosure has an inlet side having a longitudinally aligned inlet opening therein equidistant from the opposing ends. It also has an outlet side having an elongated outlet slot defined therein. As a result, the air distribution enclosure emits a flow of air through the outlet slot along an elongated linear band.

The air knife assembly also includes a blower supplying air under pressure to the elongated air distribution enclosure. The blower includes an air supply duct leading to the elongated air distribution enclosure.

The improvement of the invention is comprised of a coupling interposed between the inlet opening of the elongated air distribution enclosure and the air supply duct. The coupling joins the elongated air distribution enclosure to the air supply duct and permits rotation of the elongated air distribution enclosure relative to the air supply duct about a longitudinal axis of rotation perpendicular to the elongated air distribution enclosure and centered at the inlet opening. The improvement is also comprised of laterally directed thrust nozzles on the opposing ends of the elongated air distribution enclosure. The thrust nozzles are oriented to emit tangential jets of air at a radially spaced distance from the longitudinal axis. The thrust nozzles thereby rotate the elongated air distribution enclosure about the longitudinal axis relative to the supply duct.

The system of the invention supplies air from a blower at up to ten pounds per square inch air pressure. The blower air passes through both rotating and stationary components of the coupling assembly. The coupling assembly has very low air pressure loss and low rotational resistance. The system allows the same blower air pressure supplied for the primary object of drying and blow off to be used to also rotate an air delivery device. This device may be either an air knife or an air nozzle manifold. By rotating the air delivery device, greater effectiveness and efficiency of air drying and blow off is achieved. The air delivery device is rotated by thrust air jet nozzles that can be either adjustable or fixed structures.

The air delivery device is continuously rotated by means of the thrust nozzles that emit air from jets at the ends of the air delivery device. The orientation of these thrust nozzles is in a direction tangential to the axis of rotation. The air delivery device can be continuously rotated at variable speeds of from 1 to 200 rpm. The rotating force is supplied by the compressed air flow from an industrial blower at a maximum pressure of ten pounds per square inch through a low resistance, low pressure drop air coupling. The thrust nozzles on the ends of the air delivery device produce air jets that create a tangential, rotational thrust force, thereby eliminating the need for a separate, secondary drive mechanism to provide rotational force. Rather, the same air pressure that produces high velocity air blowoff and drying from the surface of parts during manufacturing or other products and other processes is used to rotate the air delivery device.

The invention may be described with greater clarity and particularity by reference to the accompanying drawings.

DESCRIPTION OF THE EMBODIMENT

Figure 1:
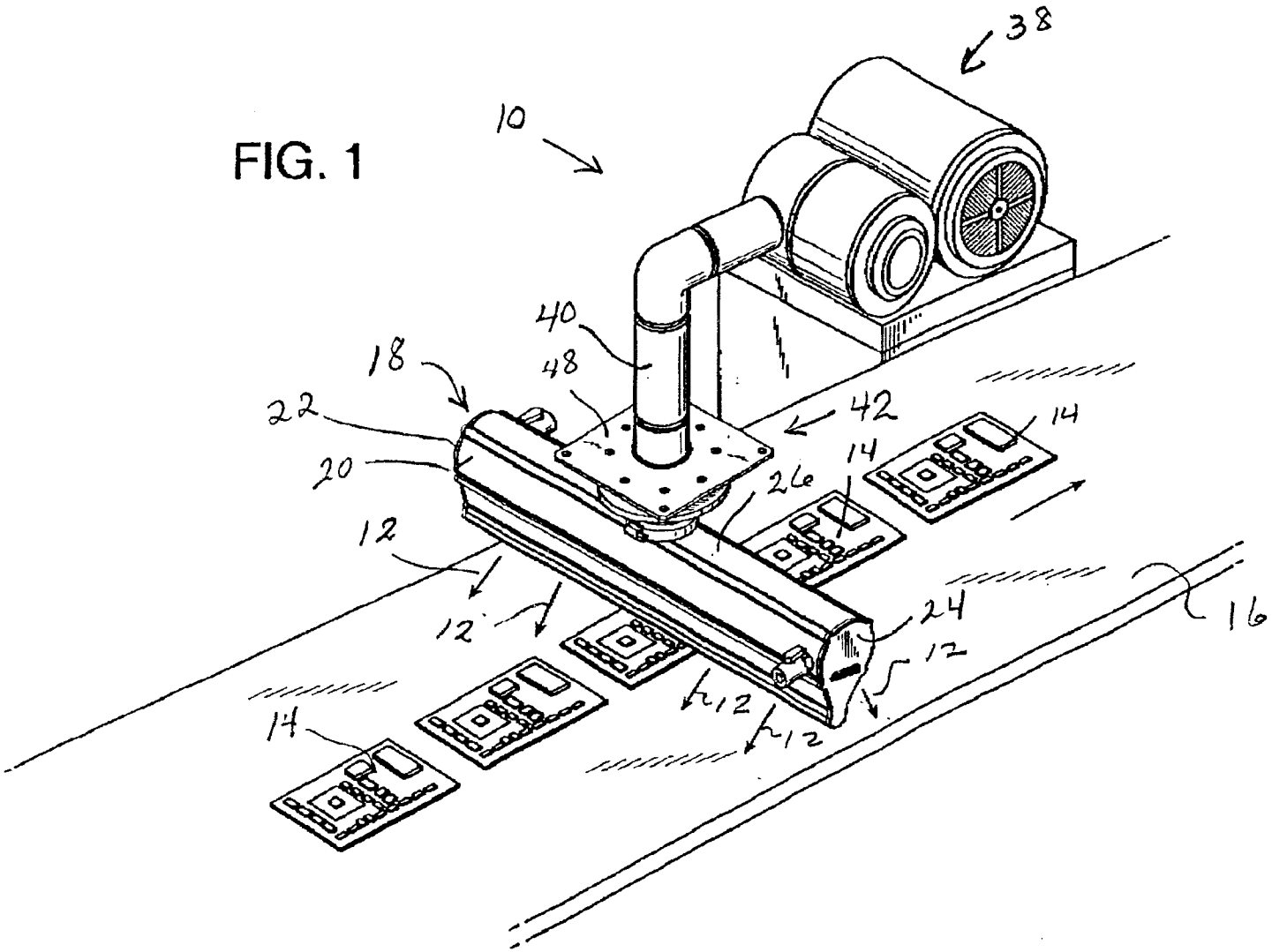
FIG. 1 is a perspective view of an apparatus for supplying and directing air under pressure onto articles passing beneath it on a conveyor belt.

FIG. 1 illustrates an air knife assembly indicated generally at 10 which is used for directing a flow of air, indicated by the directional arrows 12 at passing articles 14. In the illustration shown, the articles 14 are printed circuit boards which are carried on a conveyor belt 16 beneath the air knife 18.

The air knife 18 is comprised of a hollow, elongated air distribution enclosure 20. The enclosure 20 is a tubular structure having opposing closed ends 22 and 24 with an inlet side 26 having a longitudinally aligned inlet opening 28 therein. The longitudinally aligned opening 28 is equidistant from the opposing ends 22 and 24 and is a circular opening centered upon a longitudinal axis 30. The air distribution enclosure 20 also has an outlet side 32 having a narrow, elongated slot 34 defined therein. The air distribution enclosure 20 emits a flow of air through the outlet slot 34 along an elongated linear band indicated in phantom at 36 in FIG. 2.

The air knife assembly 10 is also comprised of a blower 38 which includes an air supply duct 40 that supplies air under pressure to the elongated air distribution enclosure 20. One suitable blower that may be utilized as the blower 38 is the Sonic 70 centrifugal blower manufactured and sold by Sonic Air Systems, located at 4111 North Palm Street, Fullerton, Calif. 92835.

The aspects of the air knife assembly 10 described thus far are conventional, as air knives have been utilized for many years for drying and cleaning a wide variety of products. However, the air knife assembly 10 shown in FIG. 1, and elsewhere in the drawings, has several unique features.

The air knife assembly 10 includes a coupling 42 interposed between the inlet opening 28 of the elongated air distribution enclosure 20 and the air supply duct 40. The coupling 42 joins the elongated air distribution enclosure 20 to the supply duct 40. The coupling 42 is constructed to permit rotation of the elongated air distribution enclosure 20 relative to the supply duct 40 about the longitudinal axis of rotation 30 which is oriented perpendicular to the alignment of the elongated air distribution enclosure 20.

The air knife assembly 10 also includes laterally directed thrust nozzles 44 that are located on both of the opposing ends 22 and 24 of the elongated air distribution enclosure 20. The thrust nozzles 44 are oriented to emit tangential jets of air at a radially spaced distance from the longitudinal axis 30 to thereby rotate the elongated air distribution enclosure 20 about the longitudinal axis 30 relative to the supply duct 40. The air jet thrust nozzles 44 are provided with adjustable valves controlled by manually operable valve levers 46 to selectively control the thrusting force of the air jets emitted by the thrust nozzles 44.

The coupling 42 is illustrated in detail in FIGS. 3, 4, 4A and 5. The coupling 42 is comprised of a mounting plate 48, an annular, stationary coupling duct 50 which also serves as a bearing housing, an annular, greaseless ball bearing ring 52, a rotatable outlet tube 54, a bearing retainer cap 56, a spacer ring 58, and a retaining ring 60.

The stationary coupling duct 50 has a cylindrical, annular neck 62 that extends upwardly through a circular, central opening 64 in the flat, generally square mounting plate 48. Eight screws 65 pass through eight mounting holes 67 in the mounting plate 48 to attach the stationary coupling duct 50 to the mounting plate 48. The neck 62 of the stationary tube 50 is joined with an airtight seal to the inlet duct 40 in coaxial alignment with the longitudinal axis 30. The stationary coupling duct 50 also is provided with a radially projecting flange 64 that extends outwardly from the central opening of the neck 62 that is centered coaxially on the longitudinal axis 30. The coupling duct 50 also has a cylindrical annular skirt 66 that extends downwardly from the periphery of the flange 64.

Figure 4:
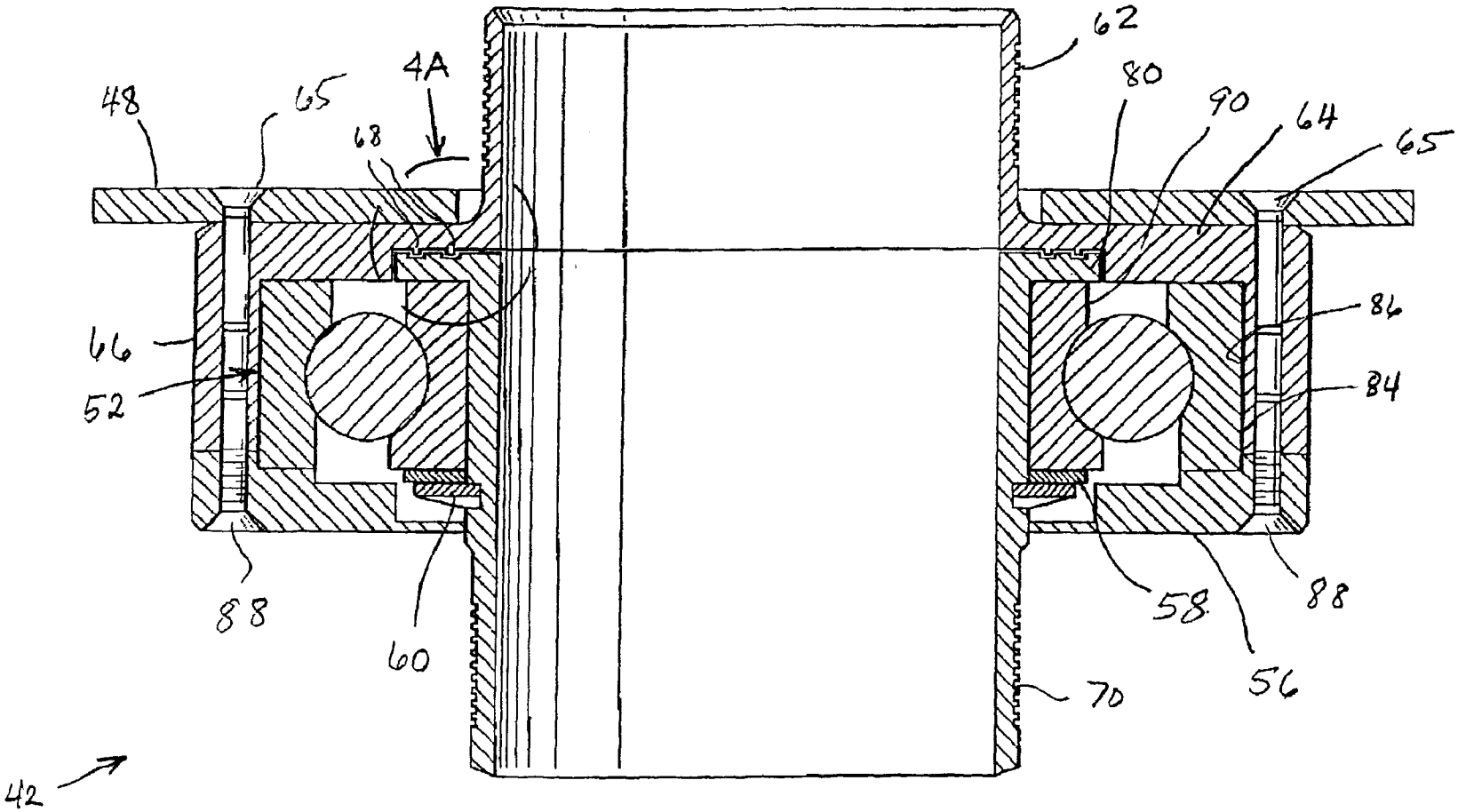
FIG. 4 is a sectional elevational view taken along the lines 4—4 in FIG. 3.
Figure 4A:
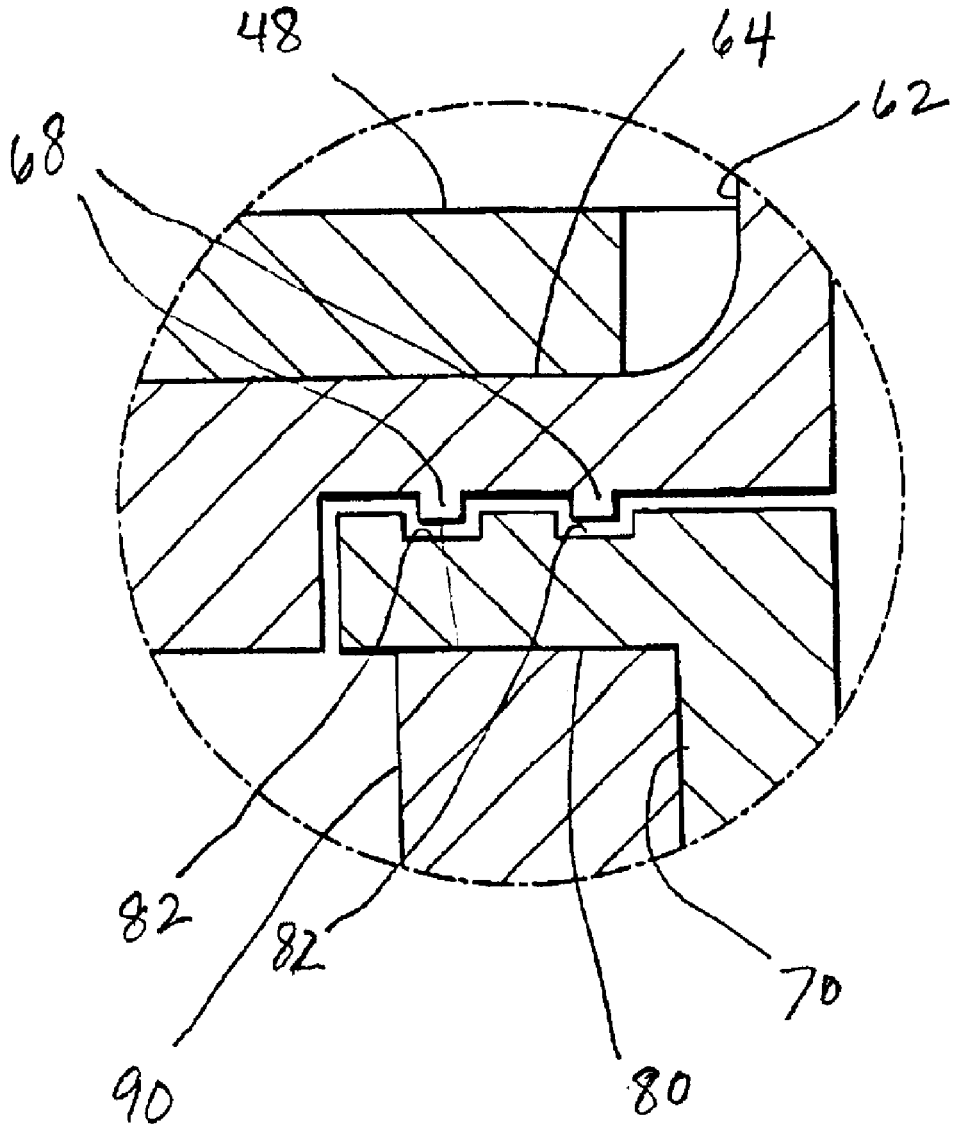
FIG. 4A is an enlarged sectional detail of the region indicated at 4A in FIG. 4.
Figure 5:
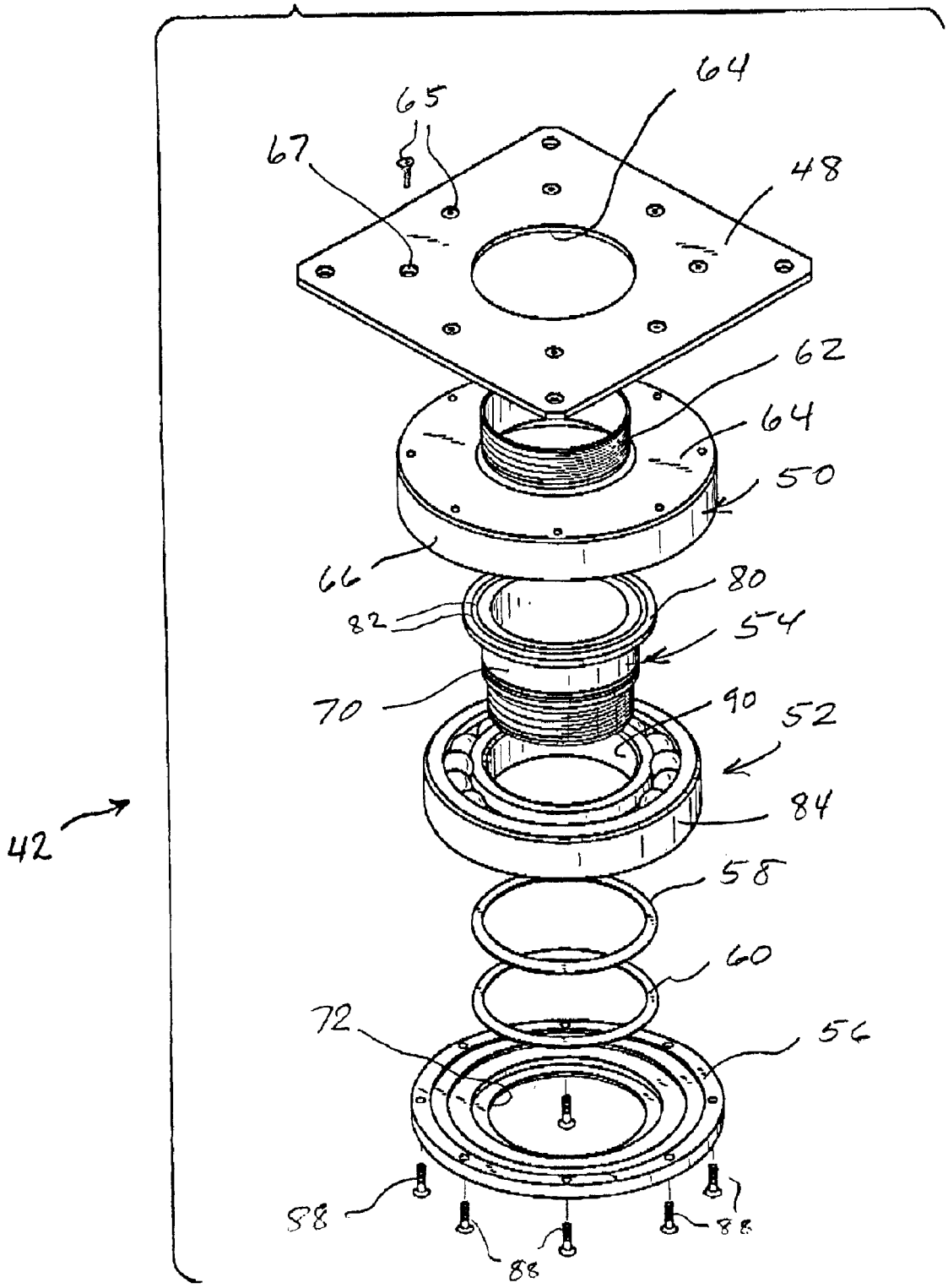
FIG. 5 is an exploded perspective view of the coupling shown in FIGS. 3 and 4.

As illustrated in FIGS. 4 and 4A, an annular, concave recess is defined in the underside of the flange 64 at the inner margin thereof proximate the neck 62. In this inner marginal region the downwardly facing surface of the flange 64 is configured to define a pair of circular, annular, downwardly facing raised rings 68 which are located at spaced radial distances from the longitudinal axis 30.

The rotatable tube 54 has a downwardly depending neck 70 that extends through a central opening 72 in the retainer cap 14. The neck 70 of the rotatable tube 54 fits within a rubber hose junction sleeve 74 and is secured thereto in airtight engagement therewith by a releaseable hose clamp 76. The air distribution enclosure 20 is provided with a neck 78 that projects upwardly from the inlet surface 26 to form the inlet opening 28. The neck 78 also fits into the lower end of the junction sleeve 74 and is secured thereto in airtight engagement therewith by another releaseable hose clamp 76. The rotatable tube 54 is a thereby connected to the air distribution enclosure 20 in coaxial alignment with the longitudinal axis 30.

The rotatable tube 54 also has an annular flange 80 at its upper end that extends radially outwardly from the neck 70. The flange 80 is configured with a pair of circular, annular upwardly facing grooves 82 that are coaxial with respect to the longitudinal axis 30 and which reside in registration with the downwardly depending rings 68 of the flange 64 of the coupling duct 50.

The greaseless bearing ring 52 is interposed between the rotatable tube 54 and the stationary coupling duct 50. As illustrated in FIG. 4, the outer raceway 84 of the bearing ring 52 slips into the bore 86 of the skirt 66 of the coupling duct 50. The outer raceway 84 of the bearing ring 52 is entrapped and secured in place between the outer, peripheral surface of the underside of the flange 64 and the bearing retainer cap 56 by means of eight screws 88 that extend upwardly through openings in the periphery of the bearing retainer cap 56 and into tapped bores in the skirt 66 of the coupling duct 50. The inner bearing race 90 of the bearing ring 52 is held in position against the underside of the flange 80 of the rotatable tube 54 by the spacer ring 58 and the retaining ring 60.

Within the coupling 42 the radially projecting flange 64 of the stationary coupling duct 50 and the radially projecting flange 80 of the rotatable tube 54 meet in a face-to-face interface. The raised rings 68 on the underside of the flange 64 project downwardly into the annular grooves 82 in the upwardly facing surface of the flange 80. The rings 68 do not fit tightly into the grooves 82, however, as the rotatable tube 54 must be free to rotate relative to the stationary coupling duct 50. Rather, and as best illustrated in FIG. 4A, the flanges 64 and 80 are configured to define a tortuous, radial path through which air must pass to escape across the face-to-face interface between the flanges 64 and 80. As a consequence, very little pressure is lost and very little air flows radially outwardly between the stationary and rotatable parts of the coupling 42.

Figure 2:
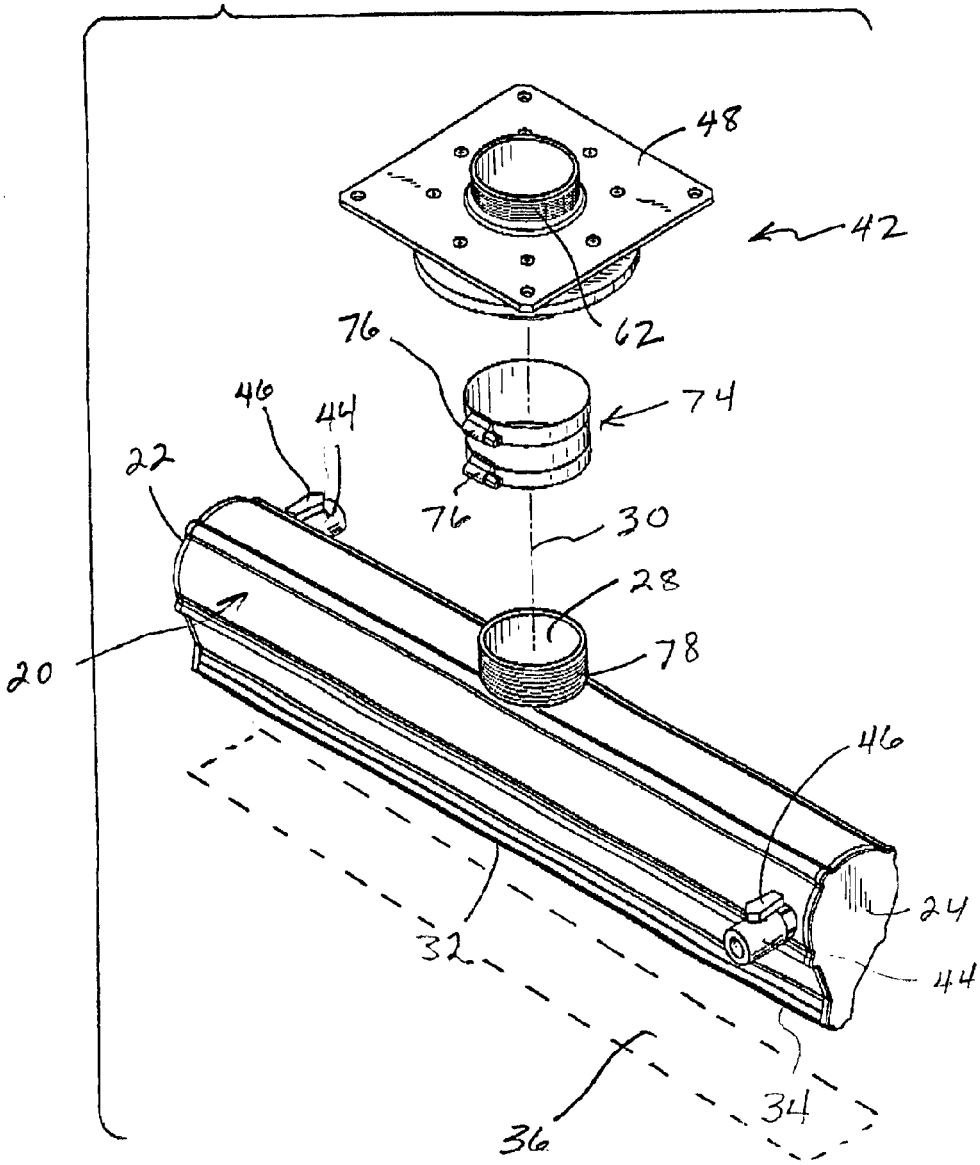
FIG. 2 is an exploded view of the air distribution enclosure and the coupling employed in the system of FIG. 1.
Figure 3:
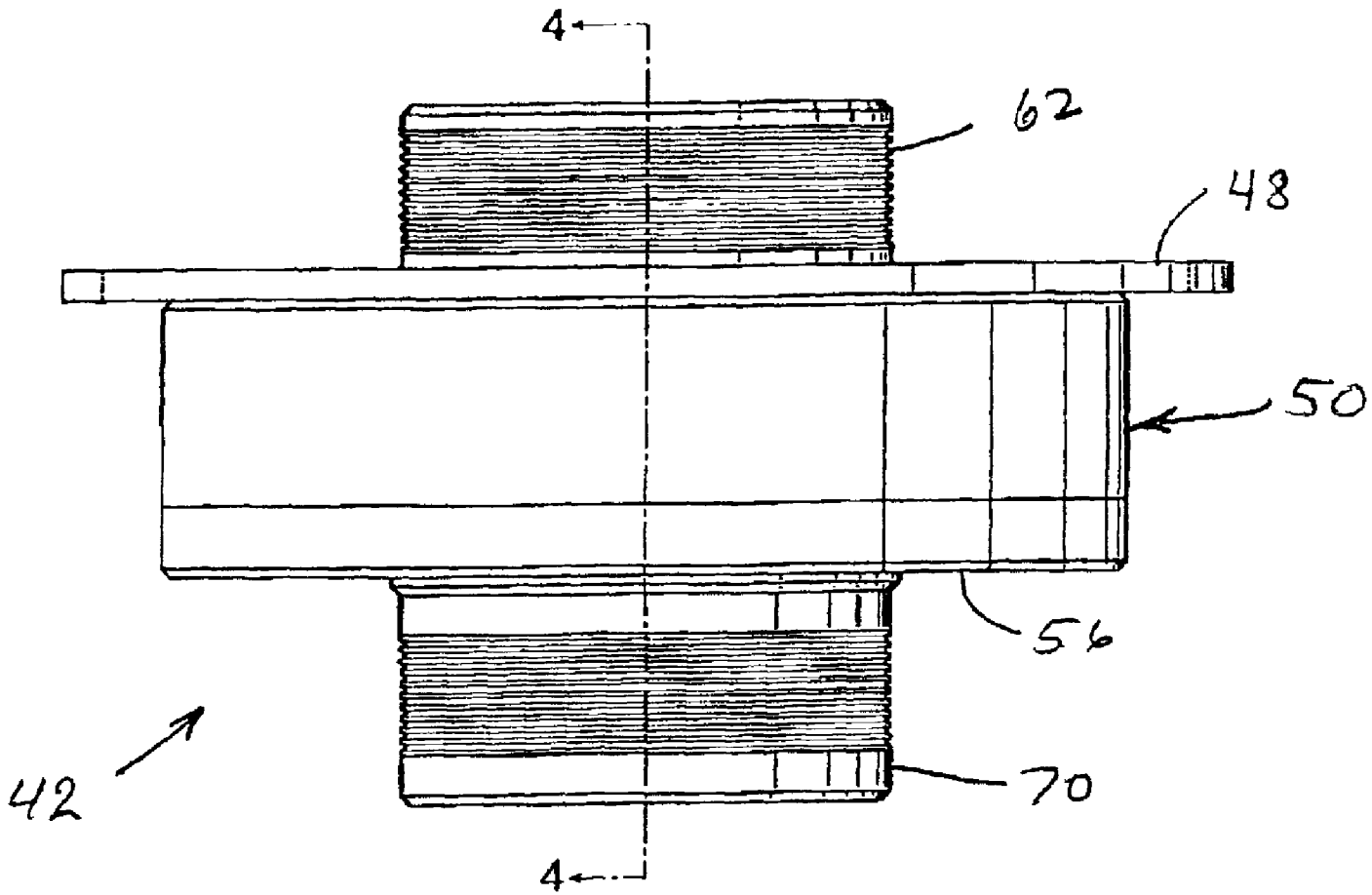
FIG. 3 is a side elevational view of the coupling employed in the system of FIG. 1.

As best illustrated with reference to FIGS. 1 and 2 of the drawings, the thrust air jet nozzles 44 rotate the air knife 18 about the longitudinal axis 30 and sweep the linear band or swath 36 in a circular path over each of the printed circuit boards 14 passing therebeneath on the conveyor 16. The rotation of the air knife 18 above the conveyor belt 16 provides an air flow 12 that does not merely impinge upon the printed circuit boards 14 in nearly a linear band 36, but rather an air flow that is directed at the articles 14 from many different directions as they are carried past the location of the air knife 18. The direction of air flow at the printed circuit boards 14 from multiple directions as the circuit boards 14 move past the air knife 18 results in far fewer blind spots and much more efficient cleaning and drying of parts moving past the air knife 18.

Figure 6:
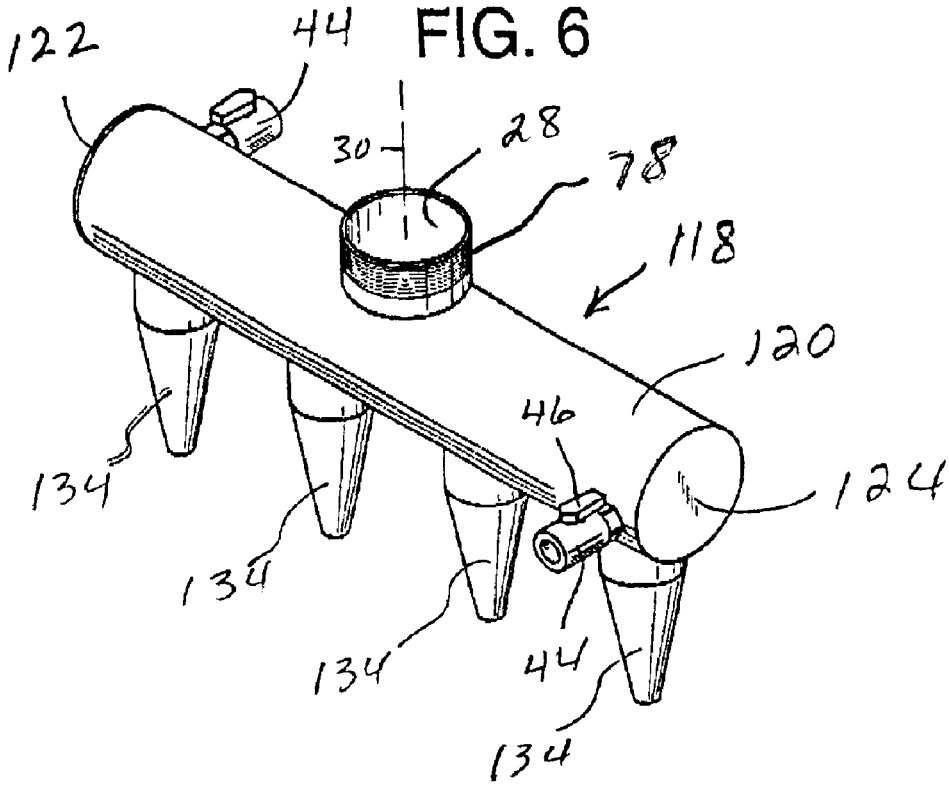
FIG. 6 is a perspective view of an air nozzle manifold that may be used in place of the air knife shown in FIG. 1.

The same principle of operation can be employed if an air nozzle manifold is substituted for the air knife 18. For example, FIG. 6 illustrates an air nozzle manifold system 118 that may be substituted for the air knife 18. Like the air knife 18, the air nozzle manifold system 118 has an elongated, tubular air distribution enclosure 120, closed at both ends 122 and 124. The air nozzle manifold system 118 also has an upwardly projecting neck 78 that defines a central inlet opening 28 equidistant from the ends 122 and 124 and which may be coupled to the rubber sleeve 74 and secured thereto by a hose clamp 76 in the manner illustrated in FIG. 2. Unlike the air knife 18, the air nozzle manifold system 118 does not emit air from a single, longitudinal slot but rather from a plurality of outlet nozzles 134. At least one of the outlet nozzles 134 is located at each of the closed ends 122 and 124 of the air distribution enclosure 120 in the embodiment of FIG. 6. There are also interior outlet nozzles 134 laterally spaced and located between the end outlet nozzles 134. Thus, the air distribution enclosure 120 directs air onto passing articles 14 along a linear band, much like the band 36 shown in FIG. 2, that is rotated over a circular area by the thrust nozzles 44.

Figure 7:
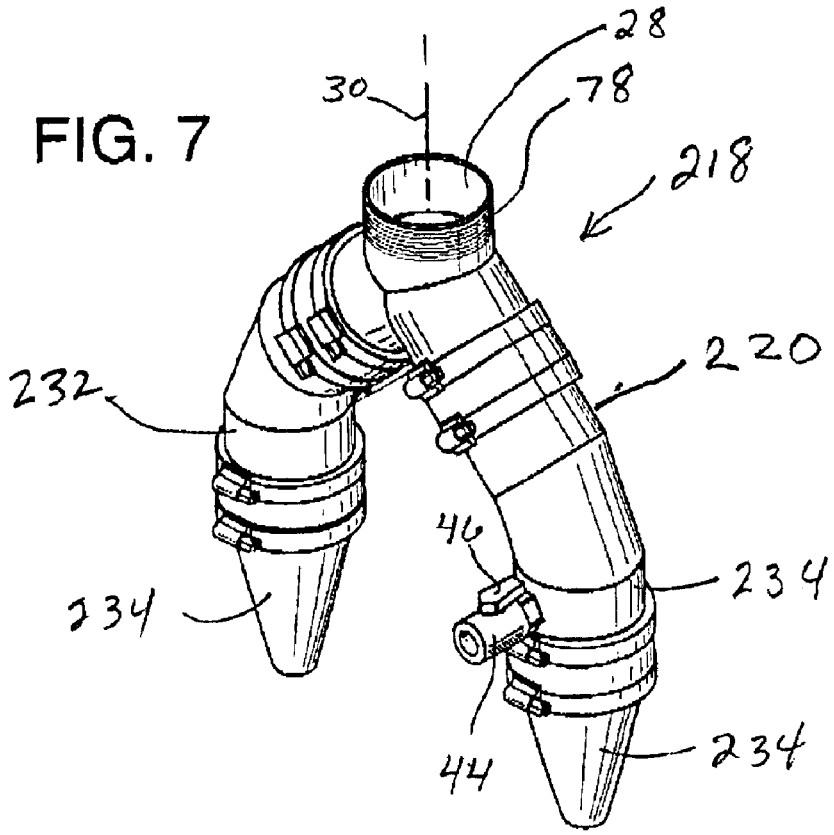
FIG. 7 is a perspective view of another embodiment of an air nozzle manifold that may be used in place of the air knife shown in FIG. 1.

FIG. 7 illustrates another embodiment of an air nozzle manifold system 218 that employs only a pair of outlet nozzles 234 at its laterally separated ends. Like the other embodiments of the invention, the air nozzle manifold system 218 includes a central, upwardly projecting neck 78 centered on the longitudinal axis 30 midway between the opposing ends 232 and 234 of the air distribution enclosure 220.

Undoubtedly, numerous variations and modifications of the invention will become readily apparent to those familiar with air knives and air nozzle manifolds utilized to dry or clean passing parts or other objects. For example, while the thrust nozzles 44 illustrated have internal valves that may be adjusted to vary the force of the air jets emitted that rotate the air knife or air nozzle manifold, thrust nozzles of fixed dimensions and configurations can be utilized as well. In addition, many different types of coupling systems may be utilized to joined the rotatable air knife or air nozzle manifold to the stationary air supply duct 40. Also, other systems for reducing air pressure loss through the coupling may be employed. Accordingly, the scope of the invention should not be construed as limited to the specific embodiments depicted and described, but rather is defined in the claims appended hereto.

We claim:

1. An apparatus for directing air under pressure at passing articles comprising:

an air distribution enclosure having opposing, laterally separated ends along a central axis and from which air under pressure is directed at said passing articles in a first direction through at least one opening;

an inlet opening located between said opposing ends and defining a longitudinal axis of rotation transverse to the central axis;

at least one thrust nozzle located on at least one of said opposing ends of said distribution enclosure to receive air and directed to emit a jet of air in a direction tangential relative to said longitudinal axis of rotation and in a direction transverse relative to the first direction;

a blower having an inlet duct leading to said inlet opening in said air distribution enclosure; and a rotatable coupling that joins said distribution enclosure to said inlet duct and which permits rotation of said air distribution enclosure relative to said inlet duct about said longitudinal axis of rotation.

2. An apparatus according to claim 1 wherein thrust nozzles are located at both of said opposing ends, and said air distribution enclosure is an elongated air knife with the opening being a narrow air discharge slot extending between said opposing ends to discharge air in the first direction in a linearly extending band that is rotated over a circular area by jets of air from said thrust nozzles.

3. An apparatus according to claim 1 wherein said thrust nozzle is provided with an adjustment mechanism to vary the force of said jet of air.

4. Apparatus according to claim 1 wherein said coupling is comprised of an annular, rotatable tube connected to said air distribution enclosure in coaxial alignment with said longitudinal axis, an annular stationary coupling duct joined to said inlet duct in coaxial alignment with said longitudinal axis, and a greaseless bearing ring interposed between said rotatable tube and said stationary coupling duct.

5. Apparatus according to claim 1 wherein said air distribution enclosure is a manifold having at least a pair of outlet nozzles, one at each of said laterally separated ends.

6. Apparatus according to claim 5 further comprising interior outlet nozzles located between said outlet nozzles at said ends, whereby said air distribution enclosure directs air onto said passing articles along a linear band that is rotated over a circular area by said thrust nozzle.

7. The apparatus of claim 1 wherein the inlet opening is located midway between the opposing ends of the air distribution enclosure.

8. An apparatus for directing air under pressure at passing articles comprising:

an air distribution enclosure having opposing, laterally separated ends along a central axis and from which air under pressure is directed at said passing articles in a first direction through at least one opening;

an inlet opening located between said opposing ends and defining a longitudinal axis of rotation transverse to the central axis;

at least one thrust nozzle located on at least one of said opposing ends of said distribution enclosure to receive air and directed to emit a jet of air in a direction tangential relative to said longitudinal axis of rotation and in a direction transverse relative to the first direction;

a blower having an inlet duct leading to said inlet opening in said air distribution enclosure; and a rotatable coupling that joins said distribution enclosure to said inlet duct and which permits rotation of said air distribution enclosure relative to said inlet duct about said longitudinal axis of rotation, wherein said coupling is comprised of an annular, rotatable tube connected to said air distribution enclosure in coaxial alignment with said longitudinal axis, an annular stationary coupling duct joined to said inlet duct in coaxial alignment with said longitudinal axis, and a greaseless bearing ring interposed between said rotatable tube and said stationary coupling duct, wherein both said rotatable tube and said stationary coupling duct are provided with radially projecting flanges that meet face to face at an interface, and said flanges are configured to define a tortuous radial path through which air must pass to escape across said face-to-face interface from within said coupling.

9. An apparatus for directing air under pressure at passing articles comprising:

an air distribution enclosure having opposing, laterally separated ends along a central axis and from which air under pressure is directed at said passing articles in a first direction through at least one opening;

an inlet opening located between said opposing ends and defining a longitudinal axis of rotation transverse to the central axis;

at least one thrust nozzle located on at least one of said opposing ends of said distribution enclosure to receive air and directed to emit a jet of air in a direction tangential relative to said longitudinal axis of rotation and in a direction transverse relative to the first direction;

a blower having an inlet duct leading to said inlet opening in said air distribution enclosure; and a rotatable coupling that joins said distribution enclosure to said inlet duct and which permits rotation of said air distribution enclosure relative to said inlet duct about said longitudinal axis of rotation, wherein said coupling is comprised of an annular, rotatable tube connected to said air distribution enclosure in coaxial alignment with said longitudinal axis, an annular stationary coupling duct joined to said inlet duct in coaxial alignment with said longitudinal axis, and a greaseless bearing ring interposed between said rotatable tube and said stationary coupling duct, wherein both said rotatable tube and said coupling duct are provided with radially projecting flanges that meet face to face at an interface, and one of said flanges is configured with at least one circular, annular groove facing said other flange and said other flange is configured with at least one circular, annular, raised ring facing said one of said flanges and said raised ring projects into said groove to define a tortuous radial path through which air must pass to cross said face-to-face interface from within said coupling.

10. An apparatus for directing a flow of air on passing articles comprising:

an air distribution structure having a longitudinal axis of rotation and opposing ends along a central axis, the longitudinal axis of rotation being transverse to the central axis, wherein said air distribution structure is configured with at least one primary outlet to emit a flow of air in a direction along a laterally extending swath, and said air distribution structure is equipped with thrusting air jet nozzles located at said opposing ends and oriented tangentially relative to said longitudinal axis of rotation so as to deliver sufficient thrust to rotate said air distribution structure about said longitudinal axis of rotation, thereby sweeping said swath in a circle centered upon said longitudinal axis of rotation.

11. Apparatus according to claim 10 wherein said air distribution structure is an air knife.

12. Apparatus according to claim 10 wherein said air distribution structure is an elongated air manifold having a plurality of primary outlet nozzles spaced along its length.

13. Apparatus according to claim 10 further comprising a blower having an inlet duct leading to said air distribution structure, and a coupling having a stationary tubular member oriented coaxially with said longitudinal axis, and said air distribution structure has an inlet opening centered on said longitudinal axis and a rotatable tubular member projecting from said inlet opening in said air distribution structure toward said stationary tubular member and in coaxial alignment therewith, and a bearing ring interposed between said stationary tubular member and said rotatable tubular member.

14. Apparatus according to claim 13 wherein said coupling forms an interface between said stationary tubular member and said rotatable tubular member that defines a tortuous path of resistance to the flow of air radially outwardly with respect to said longitudinal axis from said coupling.

15. Apparatus according to claim 10 wherein said thrusting air jet nozzles are provided with adjustable valves to selectively control their thrusting force.

16. An apparatus for directing a flow of air on passing articles comprising:

an air distribution structure having a longitudinal axis of rotation and opposing ends along a central axis, the longitudinal axis of rotation being transverse to the central axis, wherein said air distribution structure is configured with at least one primary outlet to emit a flow of air in a direction along a laterally extending swath, and said air distribution structure is equipped with thrusting air jet nozzles located at said opposing ends and oriented tangentially relative to said longitudinal axis of rotation so as to deliver sufficient thrust to rotate said air distribution structure about said longitudinal axis of rotation, thereby sweeping said swath in a circle centered upon said longitudinal axis of rotation, a blower having an inlet duct leading to said air distribution structure, and a coupling having a stationary tubular member oriented coaxially with said longitudinal axis, and said air distribution structure has an inlet opening centered on said longitudinal axis and a rotatable tubular member projecting from said inlet opening in said air distribution structure toward said stationary tubular member and in coaxial alignment therewith, and a bearing ring interposed between said stationary tubular member and said rotatable tubular member.

wherein said tubular members both have radially projecting flanges defined at their extremities, and said flanges reside in mutually facing relationship, and a plurality of annular grooves are defined in one of said flanges and a plurality of raised rings are defined in the other of said flanges, whereby said rings extend into said grooves and said flanges together define a tortuous path of resistance to the flow of air radially outwardly with respect to said longitudinal axis from said coupling.

17. In an air knife assembly for directing a flow of air at passing articles including an elongated air distribution enclosure having opposing ends along a central axis with an inlet side having a longitudinally aligned inlet opening therein equidistant from said opposing ends and an outlet side having an elongated outlet slot defined therein, whereby said air distribution enclosure emits a flow of air through said outlet slot along an elongated linear band, and a blower supplying air under pressure to said elongated air distribution enclosure and including an air supply duct leading to said elongated air distribution enclosure, the improvement comprising:

a coupling interposed between said inlet opening of said elongated air distribution enclosure and said air supply duct to join said elongated air distribution enclosure to said supply duct and said coupling permits rotation of said elongated air distribution enclosure relative to said air supply duct about a longitudinal axis of rotation perpendicular to the central axis of said elongated air distribution enclosure and centered at said inlet opening, and laterally directed thrust nozzles on said opposing ends of said elongated air distribution enclosure oriented to emit tangential jets of air at a radially spaced distance from said longitudinal axis to thereby rotate said elongated air distribution enclosure relative to said supply duct about said longitudinal axis.

18. An air knife assembly according to claim 17 said coupling includes a rotatable element connected to said inlet opening of said air distribution enclosure and a stationary element connected to said air supply duct, and said rotatable and stationary elements of said coupling meet at an interface that defines a tortuous radial path to limit the lateral escape of air from within said coupling.

19. An air knife assembly according to claim 17 wherein said thrust nozzles include infinitely adjustable orifice control mechanisms to vary the output force of said jets of air.

20. The assembly of claim 17 wherein the air blower supplies air at up to ten pounds per square inch.

21. An apparatus for directing air under pressure at passing articles comprising:

an air distribution enclosure having opposing, laterally separated end portions along a central axis and from which air under pressure is directed at said passing articles in a first direction through at least one opening and an inlet opening located between said opposing ends and defining a longitudinal axis of rotation transverse to the central axis, at least one thrust nozzle located on at least one of said opposing end portions of said distribution enclosure to receive air and directed to emit a jet of air in a direction tangential relative to said longitudinal axis of rotation and in a direction transverse relative to the first direction, a blower having an inlet duct leading to said inlet opening in said air distribution enclosure, and a rotatable coupling that joins said distribution enclosure to said inlet duct and which permits rotation of said air distribution enclosure relative to said inlet duct about said longitudinal axis of rotation.

22. The apparatus of claim 21 comprising at least one thrust nozzle located on each of said opposing end portions of said distribution enclosure to receive air and directed to emit a jet of air in a direction tangential relative to said longitudinal axis of rotation and in a direction transverse relative to the first direction.

23. The apparatus of claim 1 or 21 wherein the blower supplies air at up to ten pounds per square inch.

24. An apparatus for directing air under pressure at passing articles comprising:

an air distribution enclosure having opposing, laterally separated end portions along a central axis and from which air under pressure is directed at said passing articles in a first direction through at least one opening;

an inlet opening located between said opposing ends and defining a longitudinal axis of rotation transverse to the central axis;

at least one thrust nozzle located on at least one of said opposing end portions of said distribution enclosure to receive air and directed to emit a jet of air in a direction tangential relative to said longitudinal axis of rotation and in a direction transverse relative to the first direction;

a blower having an inlet duct leading to said inlet opening in said air distribution enclosure; and a rotatable coupling that joins said distribution enclosure to said inlet duct and which permits rotation of said air distribution enclosure relative to said inlet duct about said longitudinal axis of rotation, wherein said coupling is comprised of a rotatable tube connected to said air distribution enclosure and a stationary coupling duct joined to said inlet duct, and wherein the rotatable tube and the stationary coupling duct are configured to define between them a tortuous radial path through which air must pass to escape from within said coupling.

25. A method for applying air under pressure at passing articles comprising the steps of:

a) selecting the apparatus of claim 1 or 24;

b) positioning the selected apparatus so that the opening is directed toward the articles; and c) blowing air into the enclosure with the blower through the inlet duct so that the air is directed toward the passing articles and the enclosure rotates in a plane transverse to the longitudinal axis of rotation.

26. The method of claim 25 wherein the blower supplies air at a pressure at up to ten pounds per square inch.

27. An apparatus for directing a flow of air on passing articles comprising:

an air distribution structure having a longitudinal axis of rotation and opposing ends along a central axis, the longitudinal axis of rotation being transverse to the central axis, wherein said air distribution structure is configured with at least one primary outlet to emit a flow of air in a direction along a laterally extending swath, and said air distribution structure is equipped with thrusting air jet nozzles located at said opposing ends and oriented tangentially relative to said longitudinal axis of rotation so as to deliver sufficient thrust to rotate said air distribution structure about said longitudinal axis of rotation, thereby sweeping said swath in a circle centered upon said longitudinal axis of rotation, and wherein said tubular members are configured to define between them a tortuous path of resistance to the flow of air radially outwardly with respect to said longitudinal axis from said coupling.

28. An apparatus for directing a flow of air on passing articles comprising:

an air distribution structure having a longitudinal axis of rotation and opposing end portions along a central axis, the longitudinal axis of rotation being transverse to the central axis, wherein said air distribution structure is configured with at least one primary outlet to emit a flow of air in a direction along a laterally extending swath, and said air distribution structure is equipped with thrusting air jet nozzles located at said opposing end portions and oriented tangentially relative to said longitudinal axis of rotation so as to deliver sufficient thrust to rotate said air distribution structure about said longitudinal axis of rotation, thereby sweeping said swath in a circle centered upon said longitudinal axis of rotation.

* * * * *